US009151474B2

(12) United States Patent
Wu et al.

(10) Patent No.: US 9,151,474 B2
(45) Date of Patent: Oct. 6, 2015

(54) LIGHTING DEVICE AND ENCAPSULATING METHOD FOR LIGHTING DEVICE

(75) Inventors: Hui Wu, Guangdong (CN); Shuai Li, Guangdong (CN); Canbang Yang, Guangdong (CN); Zesheng Ye, Guangdong (CN)

(73) Assignee: OSRAM GmbH, Munich (DE)

( * ) Notice: Subject to any disclaimer, the term of this patent is extended or adjusted under 35 U.S.C. 154(b) by 67 days.

(21) Appl. No.: 13/876,205

(22) PCT Filed: Sep. 5, 2011

(86) PCT No.: PCT/EP2011/065262

§ 371 (c)(1), (2), (4) Date: Mar. 27, 2013

(87) PCT Pub. No.: WO2012/041641

PCT Pub. Date: Apr. 5, 2012

(65) Prior Publication Data

US 2013/0188358 A1 Jul. 25, 2013

(30) Foreign Application Priority Data

Sep. 30, 2010 (CN) ..... 2010 1 0514748

(51) Int. Cl.

| | |
|---|---|
| ***F21V 31/04*** | (2006.01) |
| ***F21V 15/015*** | (2006.01) |
| ***F21K 99/00*** | (2010.01) |
| *F21Y 101/02* | (2006.01) |
| *F21Y 103/00* | (2006.01) |

(52) U.S. Cl.

CPC ..... *F21V 15/015* (2013.01); *F21K 9/00* (2013.01); *F21V 31/04* (2013.01); *F21Y 2101/02* (2013.01); *F21Y 2103/003* (2013.01)

(58) Field of Classification Search

CPC .. F21V 31/04; F21V 15/015; F21Y 2103/003

USPC ..... 362/249.02, 800, 640, 646, 64 S, 650, 362/249.11

See application file for complete search history.

(56) References Cited

U.S. PATENT DOCUMENTS

| | | | | |
|---|---|---|---|---|
| 7,758,223 | B2 * | 7/2010 | Osawa et al. | 362/547 |
| 2006/0227558 | A1 | 10/2006 | Osawa et al. | |

(Continued)

FOREIGN PATENT DOCUMENTS

| | | | |
|---|---|---|---|
| CN | 101761839 | A | 6/2010 |
| GB | 2428467 | A | 1/2007 |
| WO | 2008112284 | A1 | 9/2008 |

OTHER PUBLICATIONS

Office Action issued in the corresponding Chinese application No. 2010105147485 dated Oct. 30, 2014 with English translation.

(Continued)

*Primary Examiner* — Haissa Philogene
*Assistant Examiner* — Pedro C Fernandez

(57) ABSTRACT

A lighting device may include: a cover in which a circuit board mounted with multiple lighting modules is provided, an end cap which is used to close the cover at least one end of the cover, as well as adhesive sealant, wherein the end cap includes a first portion that can be closely mounted into the cover and a second portion at the outside of the cover, and the second portion is configured to form a recess, the adhesive sealant encapsulate the cover and seal the end cap by flowing into the recess.

16 Claims, 5 Drawing Sheets

(56) References Cited

U.S. PATENT DOCUMENTS

| | | | | |
|---|---|---|---|---|
| 2007/0223218 | A1 | 9/2007 | You et al. | |
| 2007/0297183 | A1* | 12/2007 | Coushaine | 362/373 |
| 2010/0085754 | A1 | 4/2010 | Wang et al. | |
| 2010/0277914 | A1* | 11/2010 | Bachl et al. | 362/249.01 |
| 2011/0267834 | A1* | 11/2011 | Potucek et al. | 362/551 |

OTHER PUBLICATIONS

EP—Office Action based on application No. 11 757 233.9-1757 (7 pages) dated Jan. 30, 2015.

* cited by examiner

LIGHTING DEVICE AND ENCAPSULATING METHOD FOR LIGHTING DEVICE

RELATED APPLICATIONS

The present application is a national stage entry according to 35 U.S.C. §371 of PCT application No. PCT/EP2011/065262 filed on Sep. 5, 2011, which claims priority from Chinese application No. 201010514748.5 filed on Sep. 30, 2010.

TECHNICAL FIELD

Various embodiments relate to a lighting device, especially a linear light source and an encapsulating method for a lighting device, especially for a linear light source.

BACKGROUND

Luminaries for outdoor use usually need a certain level of IP protection, for example, IP65 or a higher level. To meet such needs, luminaries, such as the LED products need to be sealed to prevent water from entering the LED products. For LED linear light source, a common point of existing solution is to use a glue to pot and seal an end cap. For example, one solution in the prior art is that a glue is used to seal an end cap firstly and then potting material is potted directly at the LED, thereby realizing encapsulating the lighting device. Its weakness is that there exists color difference and bubbles on the LED surface. Another solution in the prior art is that the end cap is first sealed and then potting material is potted to the cover in which a circuit board mounted with multiple lighting modules is arranged. Its weakness is that there are too many assembling steps.

SUMMARY

Various embodiments provide a lighting device which has fine sealing effect and fewer mounting steps to overcome the above weaknesses in the prior art.

Various embodiments provide the following solution: a lighting device including: a cover in which a circuit board mounted with multiple lighting modules is provided; an end cap which is used to close the cover on at least one end of the cover, as well as adhesive sealant, wherein the end cap includes a first portion that can be closely mounted into the cover and a second portion at the outside of the cover, and the second portion is configured to form a recess, the adhesive sealant encapsulate the cover and seal the end cap by flowing into the recess. By providing the recess, the adhesive sealant flows into the recess to realize encapsulating the end cap at the same time when the cover receiving therein the circuit board mounted with multiple lighting modules is being encapsulated. Thus the process steps are simplified and fine sealing effect is realized. In the context, "a second portion at the outside of the cover" means that the second portion does not protrude into the cover and does not tightly mounted with cover like the first portion.

In various embodiments, the second portion is designed in a way that the second portion includes a large diameter segment which is sized to protrude beyond the cover to prevent the adhesive sealant from flowing to an outer side during potting. Thus encapsulating quality is improved to reduce waste of the adhesive sealant.

In various embodiments, the second portion further includes a small diameter segment between the first portion and the large diameter segment, and the recess is formed surrounding the small diameter segment.

In various embodiments, the end cap is made from an elastomer. Thus, fine contact can be realized when the first portion cooperates with the inside of the cover to prevent the adhesive sealant from flowing into the inside of the cover. In various embodiments, the elastomer is plastic or rubber. Thus good contacting quality is realized at a low cost.

In various embodiments, the end cap is formed in one-piece with a power line for the lighting device. Thus, the process steps are further simplified and fine sealing effect of the power line is realized.

In various embodiments, the end cap is provided with an electrical contact pin at a side towards the inside of the cover, and the electrical contact pin is connected with the circuit board in the cover. Thus, effective fine electrical contact is realized when the end cap is formed in one-piece with a power line for the lighting device.

Various embodiments also design an encapsulating method configured to a lighting device, including: a) providing a circuit board mounted with multiple lighting modules, the circuit board being provided in a cover with at least one open end; b) inserting an end cap into the cover at an end side of the cover to form a first portion matching with the cover and a second portion provided at the outside of the cover, and the second portion is configured to form a recess; c) potting a adhesive sealant to the cover to seal the cover and the adhesive sealant flowing into the recess to seal the end cap; and d) curing the adhesive sealant. Thus, fine sealing effect and fewer mounting steps are realized.

In various embodiments, in c) the first portion is used to prevent the adhesive sealant from entering the inside of the cover.

In various embodiments, in c) a large diameter segment of the second portion is used to prevent the adhesive sealant from flowing to an outer side during potting.

In various embodiments, in c) a small diameter segment of the second portion forms the recess at its circumference and is surrounded by the adhesive sealant.

In various embodiments, prior to b), the end cap is formed in one-niece with a power line for the lighting device, and is provided with an electrical contact pin at a side towards the inside of the cover. Thus, the process steps are further simplified and fine sealing effect of the power line is realized.

BRIEF DESCRIPTION OF THE DRAWING

These and other details, features and advantages of the present invention can be rendered in combination with following accompanying drawings. As shown in the drawings.

DETAILED DESCRIPTION

The following detailed description refers to the accompanying drawings that show, by way of illustration, specific details and embodiments in which the invention may be practiced.

Figure 1A:
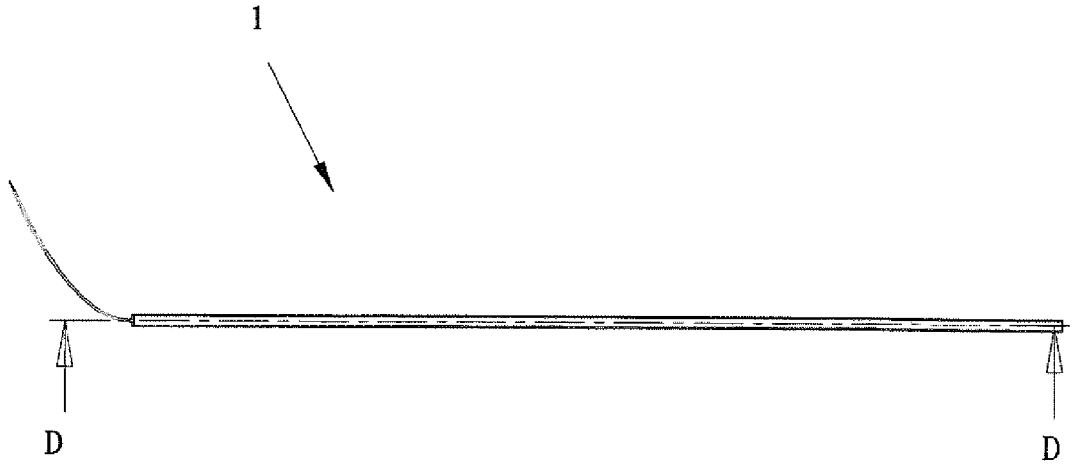
FIGS. 1A, 1B, and 1C are respectively a schematic view of the encapsulated lighting device of the present invention, a cross-section view near end cap along D-D and plan view.
Figure 1B:
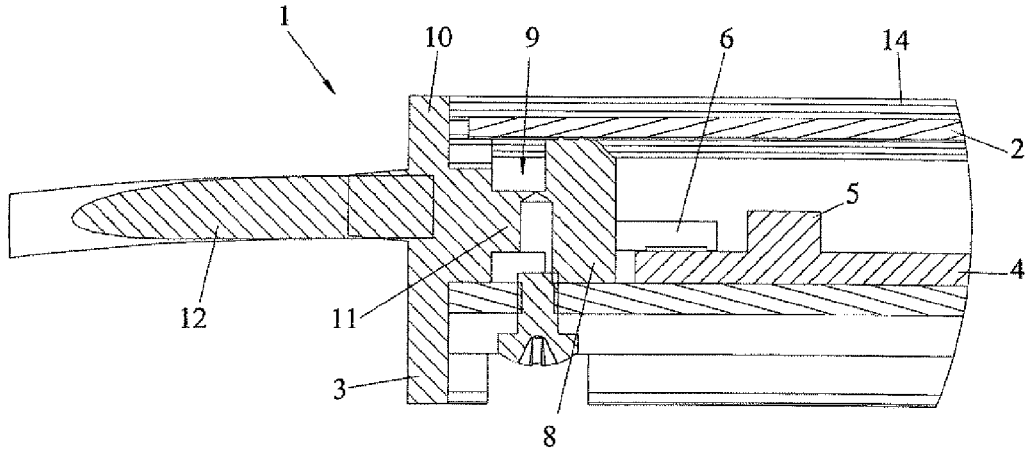
Figure 1C:
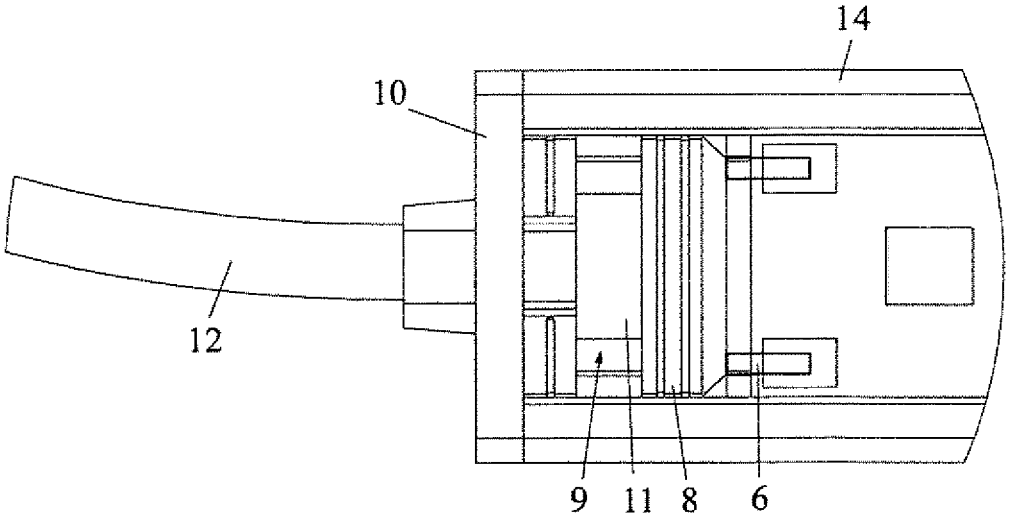

FIG. 1*a*,1*b*,1*c* are respectively a schematic view of the encapsulated lighting device of the present invention, a cross-section view near end cap along D-D of FIG. 1*a* and plan view of the lighting device of the present invention. Lighting device is LED linear light in this embodiment. The lighting device 1 comprises a cover 2 with at least one open end, in which a circuit board 4 mounted with multiple lighting modules 5 is provided. In addition, the lighting device comprises the U housing 14 made of metal. An end cap 3 is provided at the end portion of the cover 2 and is used to close the end side of the cover 2. A first portion 8 of the end cover 3 extends into the inside of the cover 2 and closely contacted with the internal surface of the cover 2. A second portion is at the outside of the cover 2. A adhesive sealant 7 is potted in the recess 9 formed by the second portion which provides potting space. At the same time, the adhesive sealant 7 is also covered around the outer surface of the cover 2, so that the encapsulating housing 13 is formed (see FIG. 3). The end cap 3 is formed in one piece with a power line 12 of the lighting device 1. By setting an electrical contact pin 6, the power line 12 is electrically connected with the circuit board 4 in the cover 2.

Figure 4:
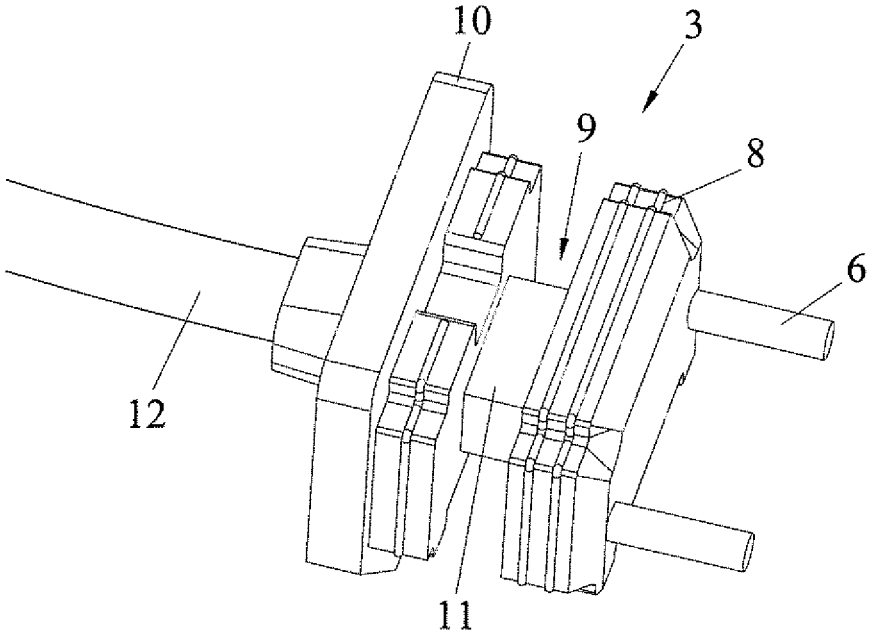
FIG. 4 is a schematic view of the end cap.

The schematic view of the end cap can be seen in conjunction with FIG. 4. The second portion of the end cap 3 comprises a large diameter segment 10 and a small diameter segment 11. A recess 9 is formed surrounding the small diameter segment 11. The large diameter segment 10 is sized to go beyond the cover 2 to prevent the adhesive sealant from flowing to an outer side during potting. The adhesive sealant is around the diameter segment 11 in order to seal the end cap 3. The end cap 3 is made from an elastomer (such as plastic and rubber). The first portion 8 of the end cap 3 extending into the inside of the cover 2 closely abuts against the internal surface of the cover 2 to realize tight assembling since the adhesive sealant is not allowed to flow into the inside of the cover 2. Electrical contact pin 6 extends from the first portion 8.

Figure 2:
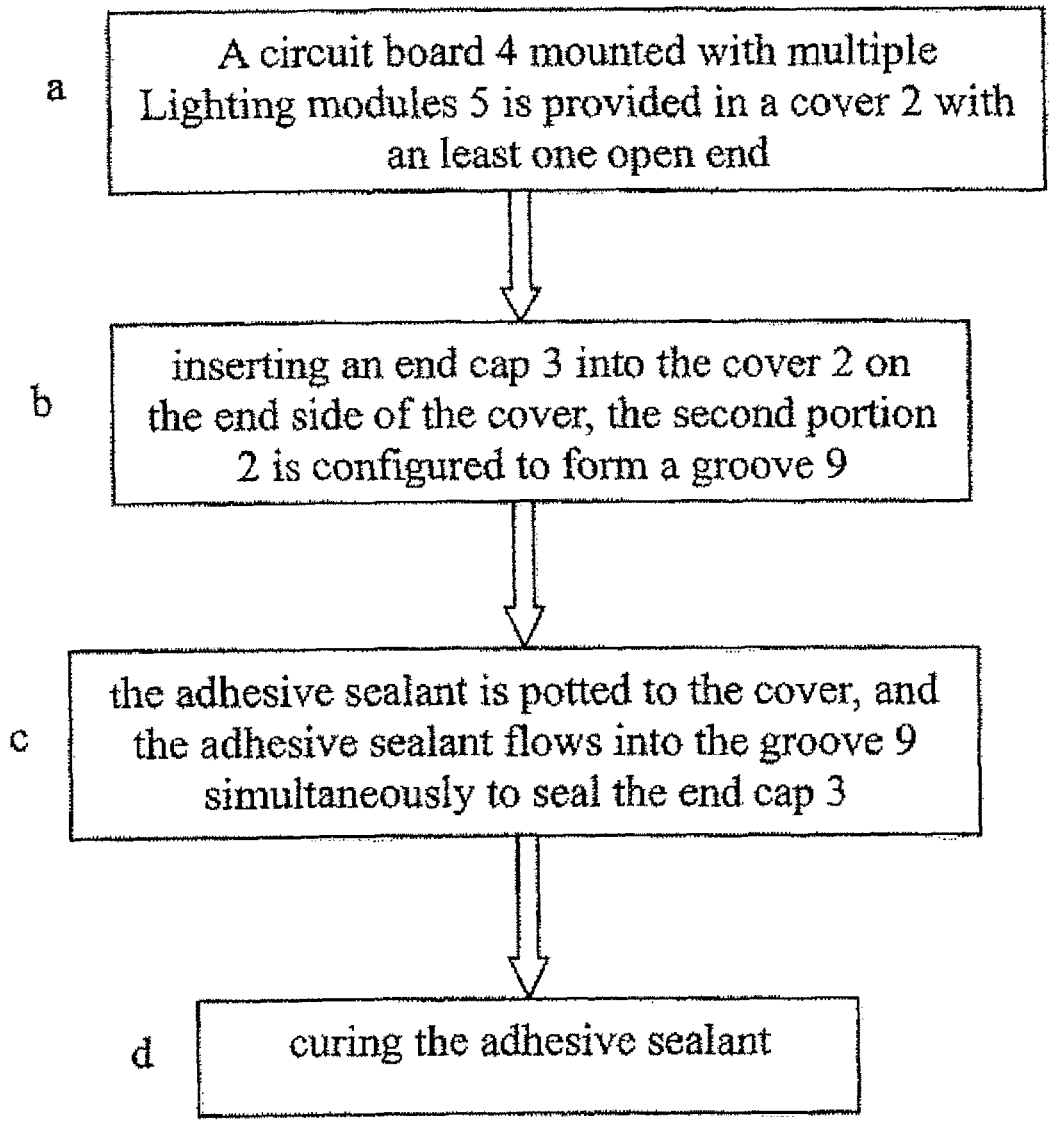
FIG. 2 is a flow chart of the method according to the present invention.

FIG. 2 is a flow chart of the method according to the present invention. The method including following steps: a) A circuit board 4 mounted with multiple lighting modules 5 is provided, the circuit board 4 is provided in a cover 2 with an least one open end; b) inserting an end cap 3 into the cover 2) on the end side of the cover 2) to form a first portion 8 matching with the cover 2 and a second portion which does not matched with cover 2, and the second portion 2 is configured to form a recess 9 c) the adhesive sealant is potted to the cover, and the adhesive sealant flows into the recess 9 simultaneously to seal the end cap 3; and d) curing the adhesive sealant.

Figure 3:
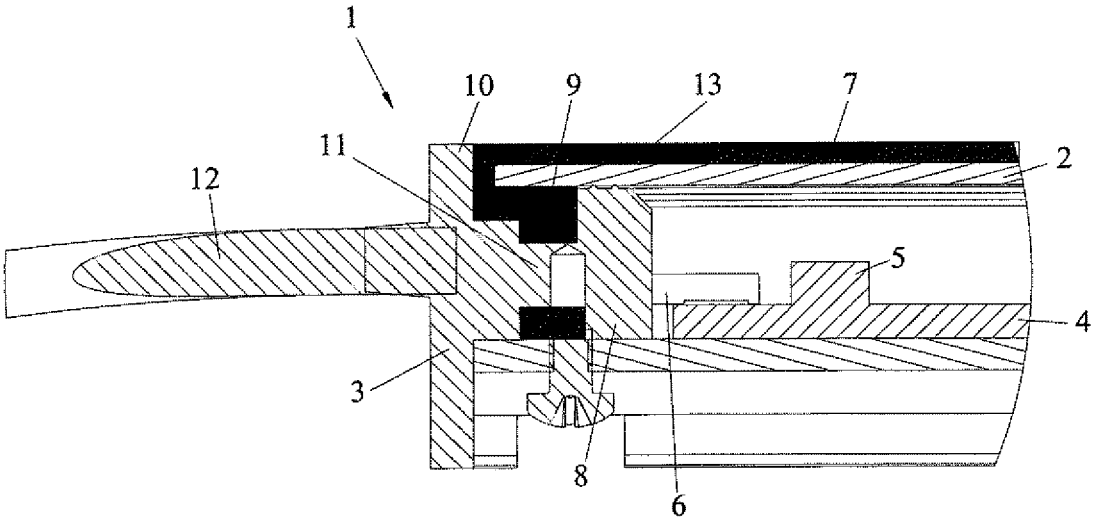
FIG. 3 illustrate the lighting device according to the present invention during the potting.

FIG. 3 illustrates the lighting device according to the present invention during the potting and after the potting. As seen from the figure, when the adhesive sealant is being potted to the cover 2, the adhesive sealant flows into the recess 9 to seal the end cap 3. Since the adhesive sealant fills the space between the U housing 14 and the cover 2 and the space between the U housing 14 and cap 3, the lighting device achieves a good IP rate.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

REFERENCE SIGNS

1 lighting device
2 cover
3 end cap
4 circuit board
5 Lighting module
6 electrical contact pin
7 adhesive sealant
8 first portion
9 recess
10 large diameter segment
11 small diameter segment
12 power line
13 encapsulating housing
14 U housing

The invention claimed is:

1. A lighting device comprising:
a cover configured to at least partially cover a circuit board having multiple lighting modules,
an adhesive sealant
an end cap, having a first portion that can be closely mounted into the cover and closely contacted with the internal surface of the cover, and a second portion configured to form a recess with the first portion
wherein the first portion includes a segment configured to guide the adhesive sealant to the recess.

2. The lighting device according to claim 1, wherein the second portion comprises a large diameter segment which is sized to protrude beyond the cover to prevent the adhesive sealant from flowing to an outer side during potting.

3. The lighting device according to claim 2, wherein the second portion further comprises a small diameter segment between the first portion and the large diameter segment, and the recess is formed surrounding the small diameter segment.

4. The lighting device according to claim 1, wherein the end cap is made from an elastomer.

5. The lighting device according to claim 4, wherein the elastomer is plastic or rubber.

6. The lighting device according to claim 1, wherein the end cap is formed in one-piece with a power line for the lighting device.

7. The lighting device according to claim 6, wherein the end cap is provided with an electrical contact pin at a side towards the inside of the cover, and the electrical contact pin is connected with the circuit board in the cover.

8. A lighting system comprising a lighting device comprising:
a cover configured to at least partially cover a circuit board having multiple lighting modules,
an adhesive sealant and
an end cap having a first portion configured to be closely mounted into the cover and closely contacted with the internal surface of the cover, and a second portion configured to form a recess with the first portion, wherein the first portion includes a segment configured to guide the adhesive sealant to the recess.

9. An encapsulating method for a lighting device, comprising: a) providing a cover having at least one open end and configured to at least partially cover a circuit board having multiple lighting modules; b) providing an end cap on the end side of the cover to form a first portion matching with the cover an closely contacting with the internal surface of the cover, and a second portion configured to form a recess with the first portion; c) potting an adhesive sealant in the recess and on the outer surface of the cover; and d) curing the adhesive sealant.

10. The encapsulating method according to claim 9, wherein in c) the first portion is used to prevent the adhesive sealant from entering the inside of the cover.

11. The encapsulating method according to claim 9, wherein in c) a large diameter segment of the second portion is used to prevent the adhesive sealant from flowing to an outer side during potting.

12. The encapsulating method according to claim 9, wherein in c) a small diameter segment of the second portion is used to form the recess at its circumference.

13. The encapsulating method according to claim 9, wherein prior to b), the end cap is formed in one-piece with a power line for the lighting device, and is provided with an electrical contact pin at a side towards the inside of the cover.

14. A lighting device comprising:

a cover having an internal surface and at least one end of the internal surface; and an external surface opposite the internal surface; the cover being configured to cover at least partially with the internal surface a circuit board mounted with multiple lighting modules; an end cap comprising:

a first portion configured to be closely mounted to the internal surface of the cover and closely contacted with the internal surface of the cover; and a second portion fixed by an adhesive sealant at least partially to a portion of the at least one end of the cover and configured to form a recess bounded by the internal surface of the cover and the first portion;

wherein the adhesive sealant extends to the external surface and to the recess.

15. The lighting device according to claim 1; wherein the adhesive sealant encapsulates the cover.

16. The lighting device according to claim 15; wherein the sealant fully encapsulates the cover.

* * * * *